US010882014B2

(12) United States Patent
Hug et al.

(10) Patent No.: US 10,882,014 B2
(45) Date of Patent: Jan. 5, 2021

(54) MIXER INSERT, STATIC MIXER AND PRODUCTION METHOD

(71) Applicant: Stamixco AG, Wollerau (CH)

(72) Inventors: Bernhard Hug, Pfäffikon (CH); Matthias Eppler, Zürich (CH)

(73) Assignee: Stamixco AG, Wollerau (CH)

( * ) Notice: Subject to any disclaimer, the term of this patent is extended or adjusted under 35 U.S.C. 154(b) by 320 days.

(21) Appl. No.: 15/781,491

(22) PCT Filed: Dec. 7, 2016

(86) PCT No.: PCT/EP2016/080149
§ 371 (c)(1),
(2) Date: Jun. 5, 2018

(87) PCT Pub. No.: WO2017/097860
PCT Pub. Date: Jun. 15, 2017

(65) Prior Publication Data

US 2020/0254401 A1 Aug. 13, 2020

(30) Foreign Application Priority Data

Dec. 8, 2015 (DE) ..... 10 2015 121 351

(51) Int. Cl.
*B01F 5/00* (2006.01)
*B01F 5/06* (2006.01)
*B01F 15/00* (2006.01)

(52) U.S. Cl.
CPC ..... *B01F 5/0619* (2013.01); *B01F 15/00935* (2013.01)

(58) Field of Classification Search
CPC ..... B01F 5/0619; B01F 15/00935; B01F 15/00928; B01F 5/06; B01F 5/0602;
(Continued)

(56) References Cited

U.S. PATENT DOCUMENTS 4,062,524 A * 12/1977 Brauner ..... B01F 5/0619 366/340
2013/0107660 A1* 5/2013 Pappalardo ..... B29C 45/44 366/336

FOREIGN PATENT DOCUMENTS

CH 642564 A5 4/1984
DE 2328795 A1 1/1975
(Continued)

OTHER PUBLICATIONS

International search report for patent application No. PCT/EP2016/080149 dated Mar. 29, 2017.

*Primary Examiner* — Anshu Bhatia
(74) *Attorney, Agent, or Firm* — Bachman and Lapointe PC; George Coury

(57) ABSTRACT

A mixer insert (1) for a static mixer, comprising a plurality of mixing elements (3, 3*a*, 3*b*, 3*c*, 3*d*, etc.) which are disposed one behind the other along a longitudinal axis (L) and preferably immediately adjoin each other and each comprise a plurality of crossing rods (8, 9; 10, 11), at least two mixing elements consecutive along the longitudinal axis (L) among the plurality of mixing elements (3, 3*a*, 3*b*; 3*b*, 3*c*; 3*c*, 3*d*; etc.) being turned relative to each other by a twist angle of preferably 90° with respect to the longitudinal axis (L), the mixer insert (1) being composed of multiple separate mixer-insert parts (2, 2*a*, 2*b*) which each extend along the longitudinal axis and which are disposed adjacent to each other perpendicular to the longitudinal axis (L), each mixer-insert part (2, 2*a*, 2*b*) having a plurality of mixing-element parts (14, 14*a*, 14*b*, 14*c*, 14*d*, etc.; 15, 15*a*, 15*b*, 15*c*, 15*d*, etc.) which are disposed one behind the other along the longitudinal axis (L) and are integrally connected to each other along the longitudinal axis (L) and immediately adjoin each other, and that the mixing-element parts (14, 15; 14*a*, 15*a*; 14*b*, 15*b*; 14*c*, 15*c*, 14*d*, 15*d*; etc.) of the mixer-insert
(Continued)

parts (2, 2*a*, 2*b*) that are disposed next to each other perpendicular to the longitudinal axis form one of the mixing elements (3, 3*a*, 3*b*, 3*c*, 3*d*, etc.), and that at least two of the mixing-element parts (14, 14*a*, 14*b*, 14*c*, 14*d*, etc.; 15, 15*a*, 15*b*, 15*c*, 15*d*, etc.) of the mixer-insert parts (2, 2*a*, 2*b*) that immediately adjoin each other along the longitudinal axis (L) are turned relative to each other by the twist angle with respect to the longitudinal axis (L).

19 Claims, 5 Drawing Sheets

(58) Field of Classification Search
CPC .... B01F 5/0603; B01F 5/0605; B01F 5/0606; B01F 5/0614; B01F 5/0615
See application file for complete search history.

(56) References Cited

FOREIGN PATENT DOCUMENTS

| | | | |
|---|---|---|---|
| DE | 2522106 | A1 | 11/1976 |
| DE | 112013006808 | T5 | 12/2015 |
| EP | 2011562 | A1 | 1/2009 |
| EP | 2001580 | B1 | 6/2010 |
| WO | 2014142869 | A1 | 9/2014 |

* cited by examiner

MIXER INSERT, STATIC MIXER AND PRODUCTION METHOD

BACKGROUND OF THE INVENTION

The invention relates to a mixer insert for a static mixer, comprising a plurality of mixing elements which are disposed one behind the other along a longitudinal axis, in particular the longitudinal center axis, and which preferably immediately adjoin each other, and each of which comprises a plurality of crossing rods, at least two mixing elements consecutive along the longitudinal axis among the plurality of mixing elements, in particular all mixing elements in an alternating fashion, are turned relative to each other by a twist angle of preferably 90° with respect to the longitudinal axis. In other words, the main directions of extension of the rods of at least two adjacent mixing elements extend at a twist angle of preferably 90° to each other. A twist of at least two adjacent mixing elements by 90°, for example, also means that the crossing axes of the mixing elements which extend perpendicular to the longitudinal axis and at which the rods cross each other are not oriented parallel but perpendicular to each other. The mixer insert is composed of multiple, in particular exclusively two or alternatively more than two, mixer-insert parts which each extend along the longitudinal axis and which are disposed adjacent to each other perpendicular to the longitudinal axis (along an axis perpendicularly intersecting a longitudinal center axis of the mixer insert and/or along an axis extending perpendicular to the longitudinal axis of the mixer insert and not intersecting a longitudinal center axis of the mixer insert), each mixer-insert part having a plurality of mixing-element parts disposed one behind the other along the longitudinal axis and integrally connected to each other along the longitudinal axis (i.e. formed in one piece and immediately axially adjoining each other), and that the mixing-element parts of the mixer-insert parts that are disposed next to each other perpendicular to the longitudinal axis form one of the mixing elements and that at least two of the mixing-element parts that adjoin each other and preferably form part of the twisted mixing elements, in particular of each mixer-insert part, are twisted relative to each other by the twist angle. As mentioned, these mixing-element parts of a respective mixer-insert part that are twisted relative to each other preferably are the mixing-element parts of a, in particular each, mixer-insert part that are part of the mixing elements that are turned relative to each other by the twist angle. As explained, two mixing-element parts that are disposed next to each other along the longitudinal axis among the mixing-element parts immediately adjoin each other, in particular in such a manner that rods of these axially consecutive mixing-element parts touch each other or merge.

Furthermore, the invention relates to a static mixer having a (multi-component) mixer insert and to a method for producing, i.e. assembling, a mixer insert, both as disclosed herein, wherein at least two, preferably exclusively two or more than two mixer-insert parts, in particular injection-molded mixer-insert parts, which extend along a longitudinal axis, in particular the longitudinal center axis of the mixer insert to be assembled, and each comprise a plurality of integrally interconnected mixing-element parts disposed one behind the other along the longitudinal axis, the mixer-insert parts being joined in at least one assembly direction extending perpendicular to the longitudinal axis (along an assembly axis intersecting or, alternatively, not intersecting the longitudinal center axis of the miser insert) in such a manner that the mixing-element parts of the mixer-insert parts that are disposed next to each other perpendicular to the longitudinal axis come together to form one of the mixer inserts, of which at least two mixing elements that are disposed next to each other along the longitudinal axis are turned relative to each other by 90°.

CH 642 564 A5 describes a static mixer that has a generic mixer insert which is disposed within a tubular container and has multiple mixing elements disposed one behind the other along a longitudinal axis of the mixer insert, the mixing elements each comprising a plurality of crossing rods. In the known mixer insert, the mixing elements are turned relative to each other by 90° in an alternating fashion with respect to the longitudinal axis. Each mixing element of the mixer insert has two groups of rods, the rods within each group being oriented parallel and the rods of one group crossing the rods of the other group, the crossing axes of adjacent mixing elements that extend perpendicular to the longitudinal extension of the mixing insert and intersect the respective crossing points extending perpendicular to each other. Production of the known mixer insert is complex and thus cost-intensive. Additionally, filling the tubular housing with the individual mixing elements to form the mixer insert is time-consuming, and ensuring that the adjacent mixing elements are each turned relative to each other by 90° is difficult. Further difficulties arise in particular in connection with the assembly of the known mixer insert if the mixing elements have a small diameter because the level of difficulty and the amount of time required for assembly increases as the mixing-element diameter decreases.

A mixer insert which is significantly simplified in terms of assembly is described in EP 2 001 580 B1. Here, multiple mixing-element disks are provided which are connected to each other via hinges and which have to be pivoted in such a manner that they are aligned in the axial direction in order to assemble the mixer insert. The known mixer insert can be produced by injection molding, but it has the disadvantage that an exact axial orientation is difficult because of the large number of individual components that have to be connected to each other in a pivotable manner, which, in turn, causes problems during assembly. Moreover, the individual mixing-element disks have a circumferential reinforcement ring, which reduces the available mixing space and adds the additional disadvantage that fluids to be mixed can escape outward in the radial direction between two of these reinforcement rings and can thus flow in the axial direction at a distance to the rods, namely axially through a radial gap space radially between the outer circumference of the reinforcement rings and the inner circumference of the tube accommodating the mixer insert. This is detrimental to the mixing result.

From EP 2 011 562 A1, a mixer insert is known which is composed of mixer-insert parts, each mixer-insert part having multiple axially spaced-apart mixing-element parts that are oriented in the same direction.

From WO 2014/142869 A1 (or DE 11 2013 006 808 T5), a static mixer is known which is composed of two mixer-insert parts, each being a one-piece part. The mixer-insert parts consist of mixing-element parts disposed along a longitudinal axis, two adjacent ones of the mixing-element parts being turned relative to each other by 90° in each case. The mixing-element parts are hollow bodies having a rhombic cross-section and flat outer walls provided with flow-through openings. Two adjacent mixing-element parts touch each other or merge in each case along transverse edges or transverse bars of the mixing-element parts that extend perpendicular to the longitudinal axis. The flow resistance for components to be mixed is comparatively high; also, the mixing effect or efficiency appears to be in need of improvement.

SUMMARY OF THE INVENTION

Based on the aforementioned state of the art, the object of the invention is to provide a mixer insert for a static mixer that can be fabricated in a simple manner, in particular by injection molding, and that is characterized by simple fabrication and by simple and quick assembly and production. Preferably, the mixer insert according to the invention is intended to not require the reinforcement rings previously needed for pressure stability in injection-molded mixer inserts. Also, the mixer insert is intended to preferably be characterized by a low flow resistance and high mixing efficiency.

Furthermore, the object is to provide a static mixer comprising a mixer insert according to the invention and a method for producing and assembling a mixer insert according to the invention.

With respect to the mixer insert, this object is attained by the features disclosed herein.

With respect to the static mixer, this object is attained by the features disclosed herein.

With respect to the method, this object is attained by the features disclosed herein.

Advantageous embodiments of the invention are presented in the dependent claims.

Any and all combinations of at least two of the features disclosed in the description, in the claims, and/or in the figures fall within the scope of the invention.

To avoid redundancies, features that are disclosed in accordance with the device shall be considered as being disclosed and claimable in accordance with the method. Likewise, features disclosed in accordance with the method shall be considered as being disclosed and claimable in accordance with the device.

The invention is based on the idea of forming the mixer insert in multiple parts so as to allow for demolding, in particular in the injection-molding process, and to ensure simple, quick and precise assembly, i.e. in the form of multiple mixer-insert parts, each of which is produced in one piece, in particular by injection molding, each mixer-insert part being characterized by a plurality of mixing-element parts disposed one behind the other (and preferably immediately adjoining each other) along the longitudinal axis, two mixing-element parts that are disposed next to each other along the longitudinal axis being integrally connected to each other, i.e. formed in one piece, the fact that the mixer-insert parts are disposed next to each other perpendicular to the longitudinal axis meaning that mixing-element parts of the adjacent mixer-insert parts are adjacent or disposed so as to be adjacent to each other perpendicular to the longitudinal axis and the mixing-element parts of the mixer-insert parts that are adjacent each other perpendicular to the longitudinal axis come together to form one of the mixing elements. In other words, multiple mixer-insert parts are joined to form a mixer insert, specifically joined perpendicular to the longitudinal axis of the mixer insert in such a manner that mixing-element parts of mixer-insert parts are adjacent to each other or disposed so as to be adjacent to each other perpendicular to the longitudinal axis of the mixer insert and the mixing-element parts adjacent to each other perpendicular to the longitudinal axis come together to form one of the mixing elements of the mixer insert in each case, at least two of the resulting mixing elements of the thus assembled mixer insert being turned relative to each other by a twist angle of in particular 90° with respect to the longitudinal axis. In the preferred case that the twist angle is 90°, this means that the crossing axes of the rods of said mixing elements adjacent and turned relative to each other not only extend perpendicular to the longitudinal axis but are also oriented at right angles, i.e. perpendicular, to each other. In mixing elements that are turned relative to each other by 90°, the main directions of extension of the rods of the adjacent mixing elements also form an angle of 90°, the rods of one of the mixing elements preferably extending along a main direction of extension (thus forming an angle with said main direction of extension) that coincides with the longitudinal axis of the mixer insert, and the rods of the other (turned) mixing element extending along a main direction of extension (thus forming an angle therewith) that is oriented perpendicular to the longitudinal axis. Aside from the preferred embodiment with a twist angle of 90°, other twist angles can be realized as well, in particular between 1° and 359°, preferably between 1° and 89°.

According to the invention, it is provided for the mixing-element parts of at least one of the mixer-insert parts, in particular all mixing-element parts of preferably all mixer-insert parts, to have crossing rods from the outset, the crossing rods of mixing-element parts adjacent to each other perpendicular to the longitudinal axis coming together to form the overall structure of a respective mixing element of the mixer insert. It is particularly advantageous if the rod portions and/or the rods of mixing-element parts of at least one of the mixer-insert parts that are disposed next to each other axially along the longitudinal axis immediately adjoin each other and are formed in one piece, i.e. are connected integrally at the contact point. As will be explained later, it is particularly preferred if not all rods or rod portions of a respective mixing-element part adjoin a rod portion or rod of the mixing-element part disposed next to it along the longitudinal axis, but that instead some of the rod portions or rods, in particular as far as to the radial half and/or as far as to the radial center of the mixer insert in the direction of the longitudinal axis, have free ends, to which, in turn, rods and/or rod portions of another mixer-insert part or of another mixing-element part of a mixer-insert part adjacent perpendicular to the longitudinal axis adjoin in the assembled state. In this way, fabrication, in particular by injection molding, is significantly simplified In terms of their longitudinal extension, the crossing rods of the mixing-element parts and of the mixing elements extend along the longitudinal center axis, but are disposed at an angle thereto.

The mixer insert according to the invention can be produced in a cost-effective and simple manner, preferably by fabrication of the mixer-insert parts by injection molding. In particular, assembly is also very simple because the mixer-insert parts simply have to be positioned next to each other perpendicular to the longitudinal axis of the mixer insert to be formed, the mixing-element parts disposed next to each other perpendicular to the longitudinal axis thus coming together to form a mixing element of the mixer insert. The mixer insert according to the invention can be used in particular as a disposable mixer insert which can be disposed of after short-term use, in particular because a chemical reaction involving hardening, such as is known from two-component adhesives, for example, happens inside it. The mixer insert according to the invention and a static mixer comprising the same can be used for any type of mixing application, in particular for the aforementioned reactive two-component systems, such as adhesives or sealing compounds.

A disposable mixer of this kind can also be used to mix explosives and the like. The mixer insert according to the invention is also suitable for mixing substances in different states of matter or in the same state of matter, such as liquid/liquid, gaseous/liquid, solid/liquid, and solid/gas. Likewise, the fluids or solids to be mixed can have different temperatures, pressures, or other physical or chemical properties.

A mixing geometry particularly suitable for the mixing elements is the Xgrid mixing element geometry, which is known per se and described in CH 642 564 A5, for example, and shown there in FIG. 1. The basic structure of mixing element geometries of this kind is also described in DE 23 28 795 or DE 25 22 106.

As mentioned, the mixer insert according to the invention is suitable in a particularly preferred manner to be produced by plastic injection molding, in particular on the basis of thermoplastics. However, the manner in which the mixer according to the invention is produced is expressly not limited thereto. In principle, production from plastic is preferred; however, production from other materials, in particular metal, is possible as well. Possible alternative production methods include 3D printing or precision casting (lost-wax casting), and production by die casting is possible, too.

As mentioned in the beginning, it is preferred if not only two or a few immediately consecutive mixing elements or mixing-element parts are turned relative to each other by the twist angle of preferably 90° with respect to the longitudinal axis (which is also realizable in principle), but that the mixing elements and/or the mixing-element parts of each mixer-insert part are turned relative to each other by the twist angle in an alternating manner in terms of their orientation to the longitudinal axis in order to thus achieve an optimal mixing result. In the preferred latter case, the mixing-element parts of adjacent mixer-insert parts comprise partial rods or rods that, in the assembled state together with the partial rods and/or rods of the mixing-element parts adjacent perpendicular to the longitudinal axis, form the rod structures of adjacent mixing elements that are offset relative to each other by the twist angle, in particular by 90°, wherein, as mentioned in the beginning, a twist of 90°, for example, means that the crossing axes extending through the contact points or crossing points of crossing rods of a rod structure or of a mixing element are also turned relative to each other by 90°, as are the main directions of extension of the rods of adjacent mixing elements.

Using the one-piece (monolithic) design and the design or disposition in which the mixing-element parts of each mixer-insert part immediately adjoin each other along the longitudinal axis, the longitudinal bars shown in EP 2 011 562 A1 can be omitted, which is preferred.

In an embodiment of the invention, it is advantageously provided for mixing-elements of at least one of the mixer-insert parts, preferably of all mixer-insert parts, that axially adjoin each other along the longitudinal axis to integrally merge with each other at free ends of the respective crossing rods. This means that the integrally formed mixing-element parts of at least one of the mixer-insert parts, unlike in the embodiment described in WO 2014/142869 A1, do not touch each other or merge at transverse bars extending perpendicular to the longitudinal extension, but that free ends of the crossing rods are directly integrally connected to each other along the longitudinal axis. This leads to increased mixing efficiency and to reduced flow resistance.

It is particularly preferred if the free ends of parallel rods and/or of rod portions of the mixing-element parts that point in the same direction along the longitudinal axis and adjoin a common mixing-element part adjacent along the longitudinal axis among the mixing-element parts are spaced apart, a clearance (free space) being maintained perpendicular to the longitudinal center axis.

In an embodiment of the invention, it is advantageously provided for some of the rods of the mixing-element parts of one, in particular both, of the mixer-insert parts and some of the rods of the mixing-element parts of the other one of the mixer-insert parts to have free ends in the direction of the longitudinal axis, the mixing-element parts adjoining each other along the longitudinal axis of mixer-insert parts adjacent to each other perpendicular to the longitudinal axis (L) being in contact with each other at their respective free rod ends in the assembled state, i.e. after having been inserted into each other perpendicular to the longitudinal axis.

An embodiment is particularly advantageous in which the mixer-insert parts mesh with each other in a form-fitting manner perpendicular to the longitudinal axis in such a manner that the mixer-insert parts are secured against relative displacement (in the assembled state) along the longitudinal axis. In other words, the mixing-element parts of the mixer-insert parts mesh with each other perpendicular to the longitudinal axis in the manner of a toothing and thus lock each other against relative movement along the longitudinal axis. An embodiment of this kind, in particular, immensely simplifies assembly because the mixer-insert parts are fixed in terms of their axial relative position, whereby insertion into a tubular, preferably cylindrical container for producing the static mixer is also simplified and made easier. In particular, it is ensured that a precise relative positioning of the mixer-insert parts for producing the mixer insert is possible in a simple manner without complex tools.

In this context, it is particularly preferred if the mixing-element parts of the mixer-insert parts have the same longitudinal extension, i.e. the same extension along the longitudinal center axis, so that the space between two mixing-element parts oriented in the same direction and spaced-apart by a mixing-element part turned relative thereto corresponds to the axial extension (longitudinal extension) of a mixing-element part of the adjacent mixer-insert part that can be inserted into this space, which means that the space between the identically oriented mixing-element parts does not have to be widened by bending the receiving mixer-insert part during or for insertion, which is the case in the solution described in WO 2014/142869 A1, for example. In other words, the mixing-element parts of one of the mixer-insert parts engage, preferably not axially, into mixing-element parts of the other mixer-insert part that are adjacent to each other along the longitudinal axis.

It is preferred if the mixing-element parts of the mixer-insert parts, in particular all mixing-element parts, at least have rod portions (partial rods), the rod portions of mixing-element parts adjacent to each other perpendicular to the longitudinal axis being complementary or matched to each other in such a manner that their rod portions come together to form the crossing rods of the mixing elements.

With respect to a version of a mixer insert that is optimized in terms of low tool costs, it is particularly advantageous if the mixer-insert parts needed to form a mixer insert are identical. In this way, the multi-part mixer insert can be fabricated by producing multiple, in particular exclusively two or more than two, identical mixer-insert parts using only one injection-molding tool.

With a view to simple assembly and production of the mixer insert and of the mixer-insert parts, it is preferred if the mixing-element parts of the mixer-insert parts (adjacent to each perpendicular to the longitudinal axis) that are adjacent to each other perpendicular to the longitudinal axis are in contact with each other at a separating plane or contact plane, which preferably accommodates the longitudinal axis, in order to form or come together to form one of the mixing elements, and that the separating or contact planes of (at least) two mixing elements disposed next to each other along the longitudinal axis are turned relative to each other by the twist angle of preferably 90° with respect to the longitudinal axis. In other words, the separating or contact planes of two adjacent mixing elements at which the mixing-element parts of said adjacent mixing elements are in contact with each other perpendicular to the longitudinal axis of the mixer insert are perpendicular to each other. In particular if the mixing elements are disposed in an alternatingly turned manner, it is advantageous if all separating planes of the mixer insert at which at least two mixing-element parts are in contact with each other to form one of the mixing elements are turned relative to each other by the twist angle of in particular 90°.

Preferably, the separating planes at which two mixing-element parts are in contact with each other are offset radially inward with respect to the outer circumference or the outer surface of the mixer insert, the separating planes, at their ends spaced apart along the longitudinal axis, preferably each meeting a radial plane each formed or defined by a mixing-element part, a mixing-element part of the adjacent mixer-insert part that is adjacent perpendicular to the longitudinal axis being in contact with these radial planes which are axially spaced apart via the separating plane.

In other words, a separating plane is located between two radial planes adjacent to each other along the longitudinal axis, each radial plane being formed or defined by a front side of a mixing element part of the mixer-insert part, said front side oriented in the direction of the longitudinal axis. At these radial planes, a mixing-element part of a mixer-insert part adjacent perpendicular to the longitudinal axis can be supported or be in contact, specifically preferably again with a respective radial plane, said radial planes being formed or limited by the front sides of said adjacent mixing-element that face away from each other.

It is particularly advantageous if at least one of the der mixer-insert parts, preferably all mixer-insert parts, has or (each) have a pair of mixing-element parts, preferably multiple pairs of mixing-element parts, each comprising first and second mixing-element parts (of the total number of mixing-element parts), which are turned relative to each other by 90° with respect to the longitudinal axis, and that the first mixing-element part has multiple rods disposed one behind the other along a first transverse axis extending perpendicular to the longitudinal axis, rods that are adjacent to each other (i.e. adjoin each other or are disposed next to each other) along the first transverse axis crossing each other and defining at least one first opening that is open in the direction of the first transverse axis, i.e. through which one can look into the first transverse axis, and that the second mixing-element part has multiple rods disposed one behind the other along a second transverse axis extending perpendicular to the longitudinal axis and perpendicular to the first transverse axis, rods that are adjacent to each other (i.e. are disposed next to each other) along the second transverse axis crossing each other and defining at least one second opening that is open in the direction of the second transverse axis, meaning one can look through it onto the second transverse axis.

When the rods of mixing-element parts of at least one mixer-insert part that are adjacent to each other along the longitudinal extension are disposed as described above, it is preferred for the rods of the first mixing-element part and the rods of the second mixing-element part to adjoin each other at a maximum of two parallel connecting lines that extend along the first transverse axis and/or a maximum of two, preferably exactly two, parallel connecting lines that extend along the second transverse axis so as to avoid undercuts, which are difficult to produce. This preferably has the consequence that some of the rods of the first mixing-element part and/or some of the rods of the second mixing-element part have free ends in the direction of the longitudinal axis, to which, in turn, free ends of rods of a mixing-element part of the mixer-insert part adjacent perpendicular to the longitudinal extension are preferably in contact in the assembled state.

In this context, it is advantageous if the first mixing-element part does not have any pairs of crossing rods adjacent along the second transverse axis, but if such pairs are disposed next to each other in the direction of the first transverse axis only, and/or that the second element part does not have any pairs of crossing rods adjacent along the first transverse axis, but that pairs of crossing rods are disposed adjacent along the second transverse axis only.

As indicated in the beginning, it is particularly advantageous if the mixing elements of the mixer insert have an Xgrid mixing geometry, i.e. each comprise two groups of rods and the rods disposed within one group are oriented parallel and the rods of one of the groups cross the rods of the other group. It is very particularly advantageous if the mixing elements and in particular the entire mixer insert have a cross-sectional circumferential contour that is circular, oval, polygonal, rectangular, or quadratic, the inner contour of the preferably tubular container accommodating a mixer insert of this kind matching said circumferential contour in such a manner that the mixer insert substantially fills the inner circumference of the container entirely. Preferably, the mixer insert as a whole has a cylindrical shape with a circular, oval, polygonal, rectangular, or quadratic base area and/or circumferential area.

The invention also relates to a static mixer comprising an in particular tubular container in which a mixer insert according to the invention is disposed, in particular inserted, the mixer insert preferably being assembled or put together in the course of the method according to the invention by first joining multiple mixer-insert parts perpendicular to the longitudinal axis and then being disposed in the container.

Other advantages, features and details of the invention are apparent from the following description of preferred embodiments and from the drawing.

BRIEF DESCRIPTION OF THE DRAWINGS

FIG. 1*b*: shows a top view of the mixer insert of FIG. 1*a,*

In the figures, similar elements and elements having similar functions are denoted by similar reference signs.

DETAILED DESCRIPTION

Figure 1A:
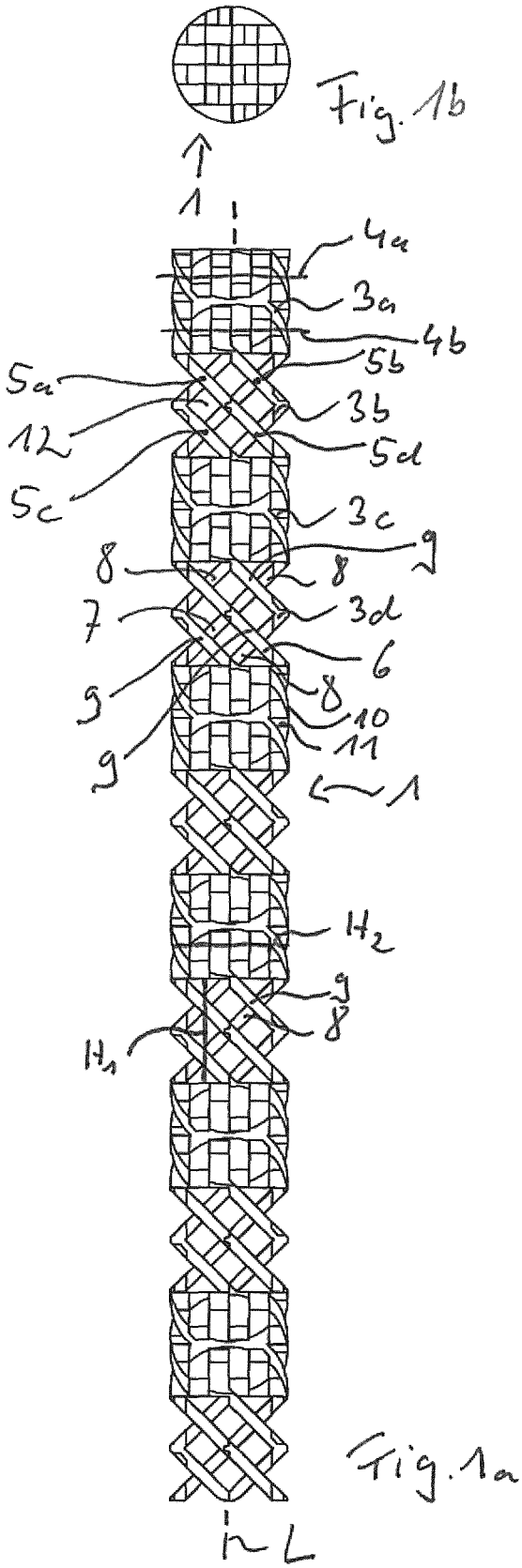
FIG. 1*a*: shows a side view of a preferred embodiment of a mixer insert according to the invention.
Figure 2:
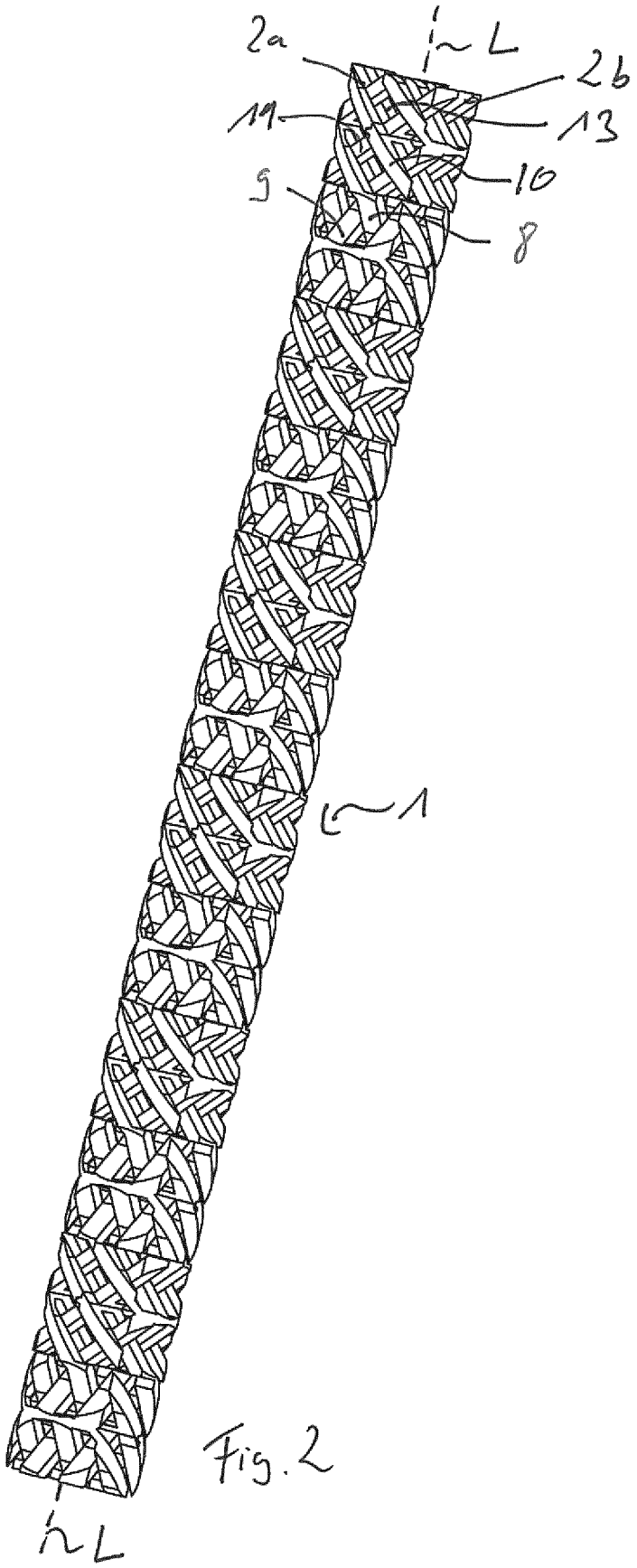
FIG. 2: shows a view, turned about the longitudinal axis in relation to FIG. 1*a*, of the mixer insert of FIGS. 1*a* and 1*b;*

In FIGS. 1*a*, 1*b* and 2, a preferred embodiment of a mixer insert 1 according to the invention for producing a static mixer is shown. In the embodiment shown, the mixer insert 1 is made of plastic, specifically by plastic injection-molding. The mixer insert 1 is composed of multiple parts and, in the embodiment shown, comprises two identical mixer-insert parts 2, which are illustrated in perspective views in FIGS. 3, 4 and 5.

To produce a static mixer, the (assembled) mixer insert 1 simply has to be inserted, along its longitudinal extension, into a preferably tubular container.

As can be seen in FIG. 1, the mixer insert 1 has a circumferential contour with a circular cross-section and has an overall circular-cylindrical contour. The mixer insert 1 comprises a plurality of mixing elements 3*a*, 3*b*, 3*c*, 3*d*, etc., which are disposed one behind the other along a longitudinal axis L (the longitudinal center axis in this case). In the embodiment shown, mixing elements 3*a*, 3*b*; 3*b*, 3*c*; 3*c*, 3*d*; etc. adjoining each other or consecutive along the longitudinal axis are alternately turned relative to each other by a twist angle, in this case an angle of (preferably) 90°, for example, with respect to the der longitudinal axis, which means that crossing axes 4*a*, 4*b* and 5*a*, 5*b*, 5*c*, 5*d*, which are to be explained later, of adjacent mixing elements 3*a*, 3*b* and of mixing elements 3*a*, 3*b* turned relative to each other by 90°, respectively, extend not only at a right angle to the longitudinal axis L but also at right angles to each other. The same applies to openings, which are to be explained later, of the mixing elements 3*a*, 3*b* turned relative to each other.

Each mixing element 3*a*, 3*b*, 3*c*, 3*d* comprises two groups 6, 7 of rods, rods 8 of one group 6 (within group 6) being oriented parallel to each other, as are rods 9 of the other group 7 (within group 7), the rods 8, 9 of the two groups 6, 7 crossing each other, specifically on the aforementioned crossing axes 4*a*, 4*b*, 5*a*, 5*b*, 5*c*, 5*d* that extend perpendicular to the longitudinal axis L. Overall, it becomes clear that the rods 8, 9 of some of the mixing elements 3*b*, 3*d*, etc. extend substantially (diagonally) in the direction of the longitudinal axis L and rods 10, 11 (cf. FIG. 2) of mixing elements turned relative thereto by 90° extend diagonally perpendicular to the longitudinal axis L. In other word, the rods 8, 9, in terms of their longitudinal extension, i.e. from their respective first axial end to their second axial end, extend along a main direction of extension $H_1$, with which they form an angle of 45° in this case, for example. The main direction of extension $H_1$ extends parallel to the longitudinal axis L. The rods 10, 11 of the adjacent mixing element extend, in terms of their respective longitudinal extension, along a second main direction of extension $H_2$, with which they form an angle of 45° in this case, for example, the second main direction of extension $H_2$ extending perpendicular to the first main direction of extension $H_1$ and perpendicular to the longitudinal axis L and parallel to a transverse axis $Q_1$, which will be explained later.

In the specific embodiment, each mixing element 3*a*, 3*b*, 3*c*, 3*d* comprises a total of six rods consecutive perpendicular to the longitudinal axis L, though this number may vary; at minimum, there are two adjacent rods, but three, four, five, six or even more than six rods can also be realized.

As can also be seen from FIG. 1*a*, the crossing rods 8, 9 and 10, 11 define openings 12, 13, respectively, the openings 12, 13 of mixing elements turned relative to each other by 90° each having an angle of 90° to each other with respect to their respective longitudinal extension oriented perpendicular to the longitudinal axis L.

Figure 3:
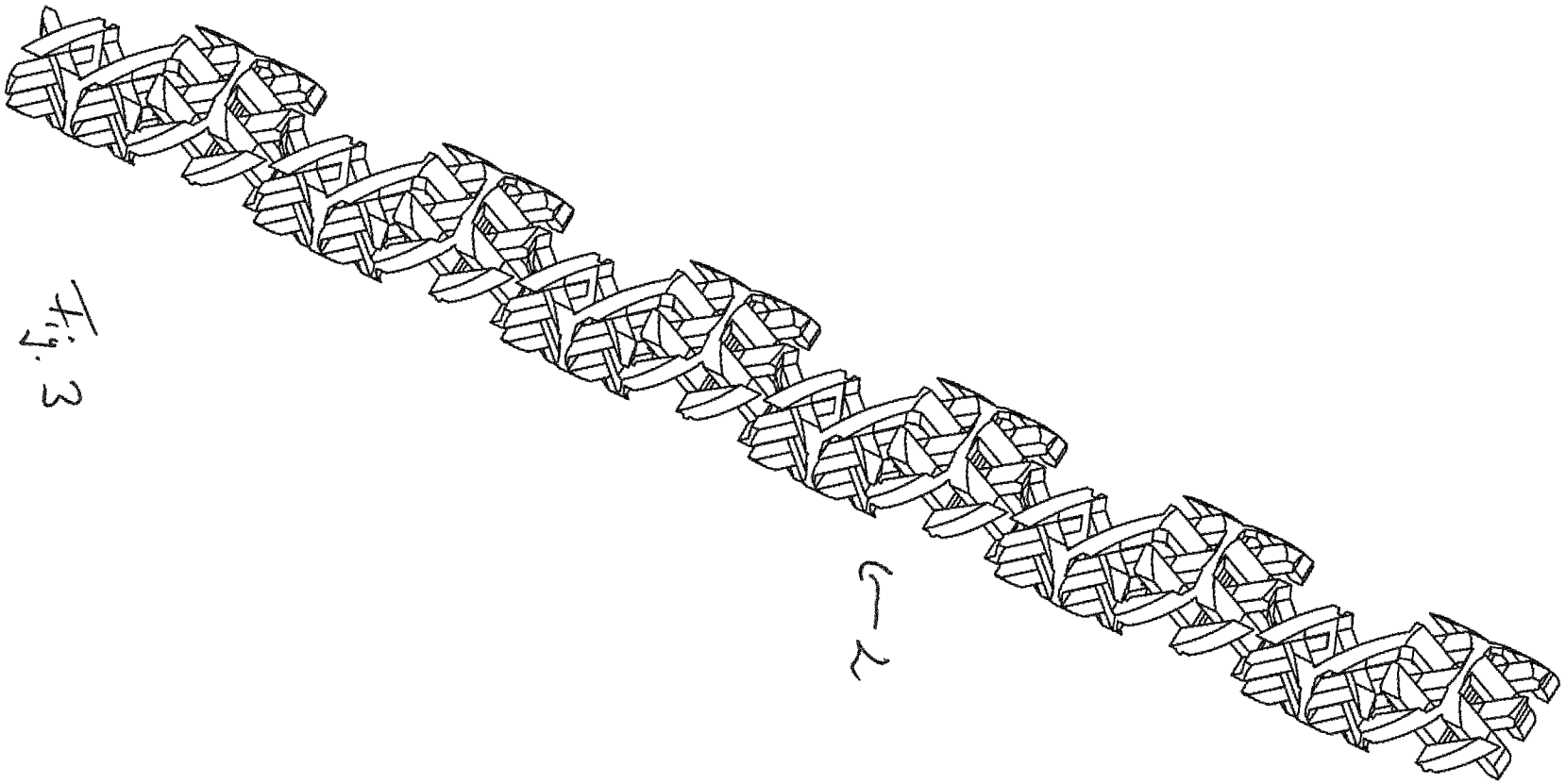
FIG. 3 and FIG. 4: show different perspective views of a mixer-insert part for forming or assembling the mixer insert of FIGS. 1*a* and 1*b;*
Figure 4:
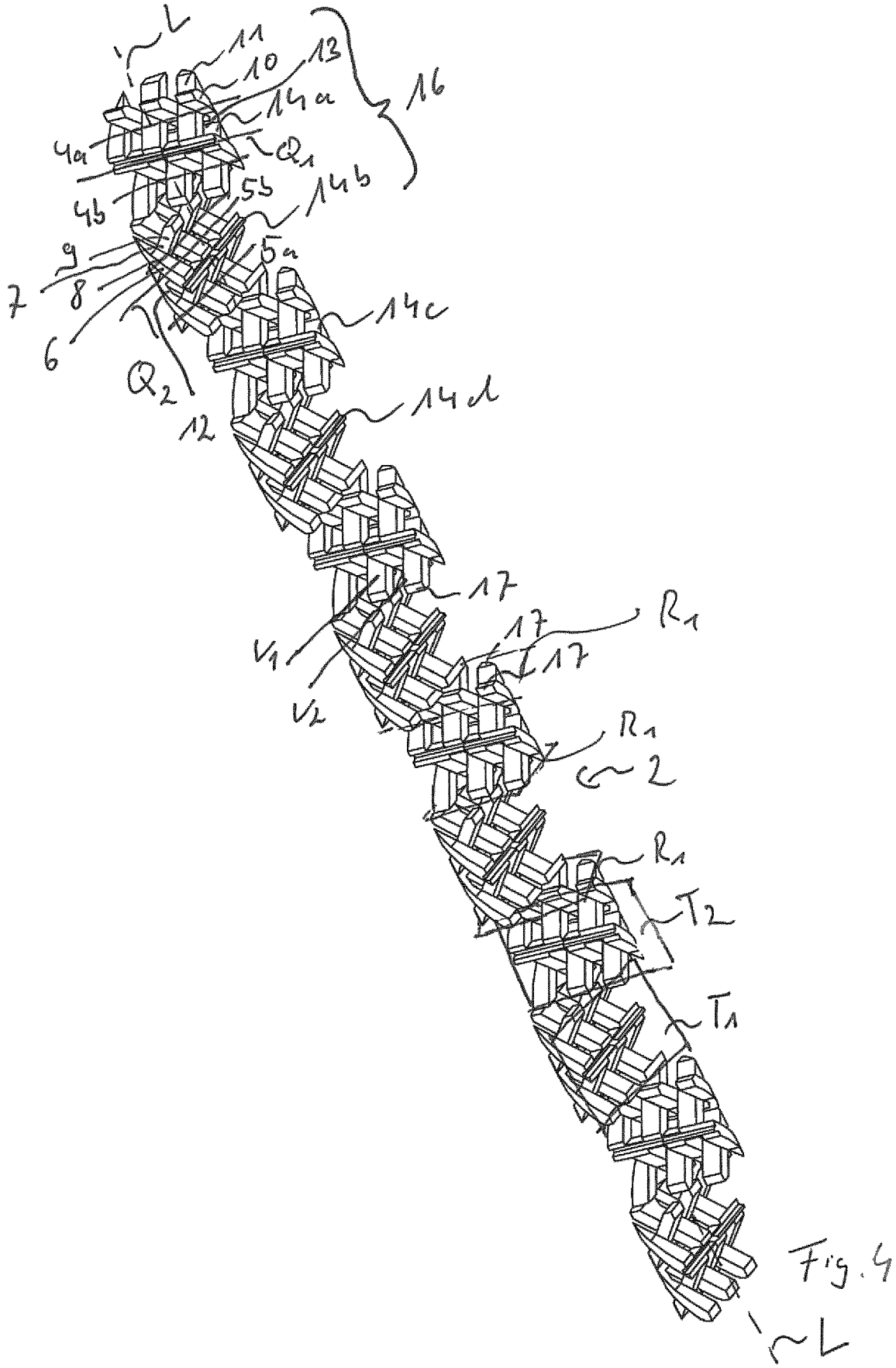

As mentioned, the mixer insert 1 illustrated in FIGS. 1*a* to 2 is composed of a total of two mixer-insert parts 2 of the kind illustrated in FIGS. 3 and 4. Alternative embodiments having more than two mixer-insert parts can also be realized. In the case at hand, the mixer-insert parts 2 and 2*a*, 2*b* (cf. FIG. 2 and FIG. 5) for forming the mixer insert 1 are identical.

FIG. 4 particularly clearly shows the structure of such a one-part mixer-insert part 2, which is preferably injection-molded in this case. A mixer-insert part 2 comprises multiple mixing-element parts 14*a*, 14*b*, 14*c*, 14*d*, etc., which are disposed one behind the other along the longitudinal axis L. In the assembled state of the mixer insert 1, as becomes clear in particular in FIG. 5, each mixing-element part 14*a*, 14*b*, 14*c*, 14*d* is assigned a mixing-element part 15*a*, 15*b*, 15*c*, 15*d* of another mixer-insert part 2, said mixing element part being adjacent perpendicular to the longitudinal axis L and mirror-symmetric to a respective separating plane, the mixing-element parts 14*a*, 15*a*; 14*b*, 15*b*; 14*c*, 15*c*; 14*d*, 15*d*; etc. opposite each other perpendicular to the longitudinal axis L coming together to form a mixing element 3*a*, 3*b*, 3*c*, 3*d*.

Specifically, in the embodiment shown, two mixer-insert parts 2*a*, 2*b*, which are identical by way of example, are moved toward each other perpendicular to the longitudinal axis L of the finished mixer insert 1 in a direction of relative movement M (assembly direction), the mixing element parts 14*a* to 14*d* and 15*a* to 15*d* meshing with each other in the manner of a toothing because of their specific disposition in the case at hand and thus forming a form-fitting connection between the mixer-insert parts 2*a*, 2*b* in the assembled state of the mixer insert 1, said connection reliably preventing relative movement of the mixer-insert parts 2*a*, 2*b* along the longitudinal axis L.

In FIG. 4, a possible structure of a preferred embodiment of a mixer-insert part 2 is shown in detail. In the embodiment shown, the mixer-insert part 2 comprises multiple pairs 16 of mixing-element parts 14*a*, 14*b* that adjoin each other in the direction of the longitudinal axis L and are integral with each other and are turned relative to each other by 90° with respect to the longitudinal axis L. A first mixing-element part 14*a* of the pair 16 comprises multiple rods 10, 11 which extend along a transverse axis $Q_1$ extending perpendicular to the longitudinal axis L, the rods 10, 11, as explained above in reference to the mixer insert 1, being disposed in two groups in this case as well, the rods 10 of one of the groups (within the group) being oriented parallel, as are the rods 11 of the other group, and the rods 10, 11 of the different groups crossing each other, specifically along crossing axes 4*a*, 4*b* which extend parallel to the first transverse axis $Q_1$. Openings 13 which are defined by the rods 10, 11 and through which one can look in the direction of the first transverse axis $Q_1$ also extend in the direction of the first transverse axis $Q_1$ or parallel thereto. The structure of the other mixing-element part 14*b* of the pair 16 is turned by exactly 90° thereto. Multiple rods 8, 9 are disposed one behind the other along a second transverse axis $Q_2$ extending perpendicular to the longitudinal axis L and perpendicular to the first transverse axis $Q_1$, the rods 8, 9 being divided into two groups of rods 8, 9, the rods 8 of one of the groups extending parallel to each other and the rods 9 of the other group 7 extending parallel to each other, the rods 8, 9 of the groups 6, 7 crossing each other, specifically along crossing axes 5*a*, 5*b* that extend parallel to the second transverse axis $Q_2$, as do the longitudinal extensions of openings 12 defined by the rods 8, 9.

As can be seen, the first mixing-element part 15*a* of the pair 16 does not have any adjacent pairs of crossing rods in the direction of the second transverse axis $Q_2$, and neither does the second mixing-element part 14*b* in the direction of the first transverse axis $Q_1$. As a result, two mixing-element parts that are disposed next to each other touch only along two connecting lines $V_1$ and $V_2$ extending parallel to the second transverse axis $Q_2$ and on parallel connecting lines $V_1$, $V_2$ extending perpendicular thereto and parallel to the first transverse axis $Q_1$, $V_1$ and $V_2$ not being illustrated for the sake of clear illustration. Accordingly, there are rods that have free ends 17 to which no rods of an immediately adjoining mixing-element part of the same mixer-insert part 2 adjoin in the direction of the longitudinal axis L.

As is also apparent from FIG. 4, each two mixing-element parts 14*a*, 14*b*; 14*b*, 14*c*; 14*c*, 14*d* etc. that are turned relative to each other by 90° define two different separating planes $T_1$, $T_2$ which are turned relative to each other by 90° and both accommodate the longitudinal axis L (the longitudinal center axis in this case) in the specific embodiment and at which the respective mixing-element parts of a mixer-insert part 2 come into contact with the mixing-element parts of another mixer-insert part 2 that are adjacent or opposite perpendicular to the longitudinal axis L.

Figure 5:
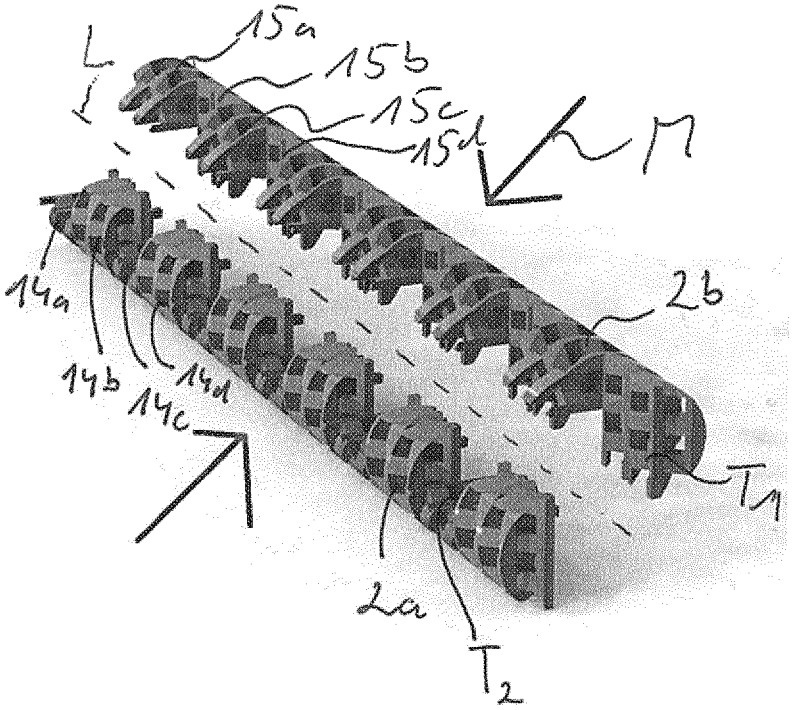
FIG. 5: shows a perspective view of two mixer-insert parts during assembly into a mixer insert according to FIGS. 1*a* to 2.

This is also apparent from FIG. 5, in particular. There, a separating plane $T_1$ is delineated that accommodates the longitudinal axis L of the mixer insert 1 in the assembled state. Spoken with reference to the drawing plane, the bottom-right outermost or end-side mixing-element parts of the adjacent mixer-insert parts 2*a*, 2*b* meet at this separating plane $T_1$. The mixing-element parts proximate along the longitudinal axis L meet at a separating plane $T_2$, which is disposed at a right angle to separating plane $T_1$ in this case and which is also traversed by the longitudinal axis L.

With regard to the position of the separating planes $T_1$ and $T_2$, reference is again made to FIG. 4. As can be seen, the first transverse axis $Q_1$ is perpendicular to the plane extension of the first separating plane $T_1$. Analogously, the second transverse axis $Q_2$ is perpendicular to the plane extension of the second separating plane $T_2$. As is further apparent from FIG. 4, the first separating planes $T_1$ are framed between two radial planes $R_1$ that are parallel to each other and perpendicular to the first separating plane $T_1$ and defined by two opposite front sides of two mixing-element parts. Likewise, the second separating planes $T_2$ are axially disposed between two radial planes $R_1$ defined by two mixing-element parts. In terms of their plane extension, the radial planes $R_1$ are perpendicular to both the first and the second separating planes $T_1$ and $T_2$ and are orthogonally traversed by the longitudinal axis L.

Figure 6:
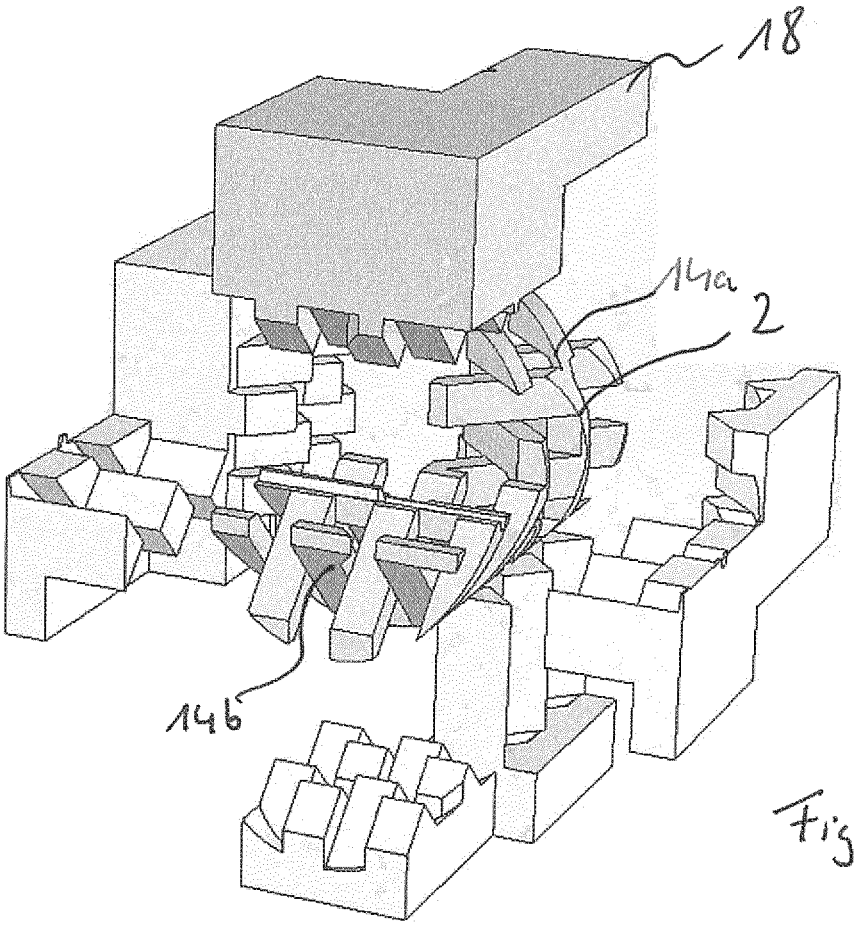
FIG. 6: shows a perspective view of an injection-molding tool section for producing a mixer-insert part according to FIGS. 3 and 4 or 5.

Finally, reference is made to FIG. 6. It shows a section of a mixer-insert part 2 comprising two mixing-element parts 14*a*, 14*b* which are turned relative to each other by 90° and are formed and disposed as described above. Also shown is an injection-molding tool 18 having multiple molds for producing the mixer-insert part 2 by injection molding.

REFERENCE SIGNS

1 mixer insert
2, 2*a*, 2*b* mixer-insert parts
3, 3*a*, 3*b*, 3*c*, 3*d*, etc. mixing elements
4, 4*a*, 4*b*, etc. crossing axes
5, 5*a*, 5*b*, 5*c*, 5*d*, etc. crossing axes
6 group
7 group
8 rods
9 rods
10 rods
11 rods
12 openings
13 openings
14, 14*a*, 14*b*, 14*c*, 14*d*, etc. mixing-element parts
15, 15*a*, 15*b*, 15*c*, 15*d*, etc. mixing-element parts
16 pair of mixing-element parts
17 free ends
18 tool
L longitudinal axis
$Q_1$ first transverse axis
$Q_2$ second transverse axis
M relative assembly direction/direction of relative movement
$H_1$ main direction of extension
$H_2$ main direction of extension
$T_1$ separating plane
$T_2$ separating plane
$R_1$ radial plane

The invention claimed is:

1. A mixer insert (1) for a static mixer, comprising a plurality of mixing elements (3, 3*a*, 3*b*, 3*c*, 3*d*, etc.) which are disposed one behind the other along a longitudinal axis (L) and each comprise a plurality of crossing rods (8, 9; 10, 11), at least two mixing elements consecutive along the longitudinal axis (L) among the plurality of mixing elements (3, 3*a*, 3*b*; 3*b*, 3*c*; 3*c*, 3*d*; etc.) being turned relative to each other by a twist angle, the mixer insert (1) being composed of multiple separate mixer-insert parts (2, 2*a*, 2*b*) which each extend along the longitudinal axis and which are disposed adjacent to each other perpendicular to the longitudinal axis (L), each mixer-insert part (2, 2*a*, 2*b*) having a plurality of mixing-element parts (14, 14*a*, 14*b*, 14*c*, 14*d*, etc.; 15, 15*a*, 15*b*, 15*c*, 15*d*, etc.) which are disposed one behind the other along the longitudinal axis (L) and are integrally connected to each other along the longitudinal axis (L), and wherein the mixing-element parts (14, 15; 14*a*, 15*a*; 14*b*, 15*b*; 14*c*, 15*c*, 14*d*, 15*d*; etc.) of the mixer-insert parts (2, 2*a*, 2*b*) that are disposed next to each other perpendicular to the longitudinal axis form one of the mixing elements (3, 3*a*, 3*b*, 3*c*, 3*d*, etc.), the mixing-element parts (14, 14*a*, 14*b*, 14*c*, 14*d*, etc.; 15, 15*a*, 15*b*, 15*c*, 15*d*, etc.) of at least one of the mixer-insert parts (2, 2*a*, 2*b*) each having crossing rods (8, 9, 10, 11), wherein the mixing-element parts (14, 14*a*, 14*b*, 14*c*, 14*d*, etc.; 15, 15*a*, 15*b*, 15*c*, 15*d*, etc.) of each mixer-insert part (2, 2*a*, 2*b*) immediately adjoin each other and at least two of the mixing-element parts (14, 14*a*, 14*b*, 14*c*, 14*d*, etc.; 15, 15*a*, 15*b*, 15*c*, 15*d*, etc.) of the mixer-insert parts (2, 2*a*, 2*b*) that immediately adjoin each other along the longitudinal axis (L) are turned relative to each other by the twist angle with respect to the longitudinal axis (L).

2. The mixer insert according to claim 1, wherein the mixing elements (3, 3*a*, 3*b*, 3*c*, 3*d*, etc.) and/or the mixing-element parts (14, 14*a*, 14*b*, 14*c*, 14*d*, etc.; 15, 15*a*, 15*b*, 15*c*, 15*d*, etc.) are turned by the twist angle with respect to the longitudinal axis (L) in an alternating manner along the longitudinal axis (L).

3. The mixer insert according to claim 1, wherein the mixer-insert parts (2, 2*a*, 2*b*) mesh with each other in a form-fitting fashion perpendicular to the longitudinal axis (L) in such a manner that the mixer-insert parts (2, 2*a*, 2*b*) are secured against relative displacement along the longitudinal axis.

4. The mixer insert according to claim 1, wherein the mixing-element parts (14, 14*a*, 14*b*, 14*c*, 14*d*, etc.; 15, 15*a*, 15*b*, 15*c*, 15*d*, etc.) of at least one of the mixer-insert parts (2, 2*a*, 2*b*) have rod portions and rod portions of mixing-element parts (14, 15; 14*a*, 15*a*; 14*b*, 15*b*; 14*c*, 15*c*; 14*d*, 15*d*, etc.) adjacent to each other perpendicular to the longitudinal axis (L) come together to form the crossing rods (8, 9, 10, 11) of the mixing elements (3, 3*a*, 3*b*, 3*c*, 3*d*, etc.).

5. The mixer insert according to claim 1, wherein a portion of the rod portions and/or rods (8, 9; 10, 11) of mixing-element parts (14, 15; 14*a*, 15*a*; 14*b*, 15*b*; 14*c*, 15*c*; 14*d*, 15*d*; etc.) disposed axially next to each other immediately adjoin each other.

6. The mixer insert according to claim 1, wherein rods (8, 9; 10, 11) of the mixing-element parts (14, 15; 14*a*, 15*a*; 14*b*, 15*b*; 14*c*, 15*c*; 14*d*, 15*d*; etc.) adjacent to each other perpendicular to the longitudinal axis (L) extend parallel to each other.

7. The mixer insert according to claim 1, wherein mixing-element parts that adjoin each other along the longitudinal axis (L) among the mixing-element parts (14, 14*a*, 14*b*, 14*c*, 14*d*, etc.; 15, 15*a*, 15*b*, 15*c*, 15*d*, etc.) of at least one of the mixer-insert parts (2, 2*a*, 2*b*) integrally merge with each other at free ends of the respective crossing rods (8, 9, 10, 11) and/or wherein some of the rods (8, 9, 10, 11) of the mixing-element parts of one of the mixer-insert parts and some of the rods of the mixing-element parts of the other one of the mixer-insert parts have free ends in the direction of the longitudinal axis, the respective free rod ends of the mixing-element parts adjoining each other along the longitudinal axis of mixer-insert parts adjacent to each other perpendicular to the longitudinal axis (L) are in contact with each other in the assembled state.

8. The mixer insert according to claim 7, wherein the free ends of parallel rods and/or rod portions of the mixing-element parts (14, 14*a*, 14*b*, 14*c*, 14*d*, etc.; 15, 15*a*, 15*b*, 15*c*, 15*d*, etc.) that point in the same direction and adjoin a common mixing-element part adjacent along the longitudinal axis (L) among the mixing-element parts (14, 14*a*, 14*b*, 14*c*, 14*d*, etc.; 15, 15*a*, 15*b*, 15*c*, 15*d*, etc.) are spaced apart, a clearance being maintained perpendicular to the longitudinal center axis (L).

9. The mixer insert according to claim 1, wherein the mixer-insert parts (2, 2*a*, 2*b*) that are adjacent to each other perpendicular to the longitudinal axis (L) are identical.

10. The mixer insert according to claim 1, wherein to form one of the mixing elements (3, 3*a*, 3*b*, 3*c*, 3*d*, etc.), the mixing-element parts (14, 15; 14*a*, 15*a*; 14*b*, 15*b*; 14*c*, 15*c*; 14*d*, 15*d*; etc.) of the mixer-insert parts (2, 2*a*, 2*b*) that are each adjacent to each other perpendicular to the longitudinal axis (L) are in contact with each other at a separating plane ($T_1$, $T_2$), which accommodates the longitudinal axis (L), and wherein the separating planes ($T_1$, $T_2$) of two mixing elements (3; 3*a*, 3*b*; 3*b*, 3*c*; 3*c*, 3*d*; etc.) disposed next to each other along the longitudinal axis (L) are turned relative to each other by 90° with respect to the longitudinal axis (L), all separating planes ($T_1$, $T_2$) being turned relative to each other by 90° in an alternating manner.

11. The mixer insert according to claim 1, wherein at least one of the mixer-insert parts (2, 2*a*, 2*b*) has a pair (16) of mixing-element parts each pair (16) comprising a first mixing-element part and a second mixing-element part (14; 14*a*, 14*b*; 14*b*, 14*c*; 14*c*, 14*d*; 15; 15*a*, 15*b*; 15*b*, 15*c*; 15*c*, 15*d*; etc.) which are turned relative to each other by 90° with respect to the longitudinal axis, and wherein the first mixing-element part (14*a*) has multiple rods (8, 9) which are disposed one behind the other along a first transverse axis ($Q_1$) extending perpendicular to the longitudinal axis (L), rods (10, 11) that are adjacent to each other along the first transverse axis ($Q_1$) crossing each other and defining at least one first opening (12) which is open in the direction of the first transverse axis ($Q_1$), and wherein the second mixing-element part (14*b*) has multiple rods (10, 11) disposed one behind the other along a second transverse axis ($Q_2$) extending perpendicular to the longitudinal axis (L) and perpendicular to the first transverse axis ($Q_1$), rods (10, 11) that are adjacent to each other along the second transverse axis ($Q_2$) crossing each other and defining at least one second opening (13) open in the direction of the second transverse axis ($Q_2$).

12. The mixer insert according to claim 11, wherein the rods (8, 9) of the first mixing-element part (14*a*) and the rods (10, 11) of the second mixing-element part (14*b*) adjoin each other at no more than two parallel connecting lines ($V_1$, $V_2$) extending along the first and/or second transverse axis ($Q_1$, $Q_2$).

13. The mixer insert according to claim 11, wherein the first mixing-element part (14*a*) does not have any pairs of crossing rods (8, 9; 10, 11) that are adjacent along the second transverse axis ($Q_2$) and/or wherein the second mixing-element part (14*b*) does not have any pairs of crossing rods (8, 9; 10, 11) that are adjacent along the first transverse axis ($Q_1$).

14. The mixer insert according to claim 1, wherein the rods (8, 9; 10, 11) of the mixing elements (3, 3*a*, 3*b*, 3*c*, 3*d*, etc.) are each disposed in two groups (6, 7), and wherein the rods (8, 9; 10, 11) within a first group (6, 7) of the two groups are oriented parallel to each other and the rods (8, 9; 10, 11) of a second group of the two groups (6, 7) cross the rods (8, 9; 10, 11) of the first group (6, 7), and wherein the mixing elements (3, 3*a*, 3*b*, 3*c*, 3*d*, etc.) have a circular, oval, polygonal, rectangular, or square cross-sectional circumferential contour.

15. Mixer insert according to claim 1, wherein the mixing-element parts (14, 14*a*, 14*b*, 14*c*, 14*d*, etc.; 15, 15*a*, 15*b*, 15*c*, 15*d*, etc.) of the mixer-insert parts (2, 2*a*, 2*b*) have the same extension along the longitudinal axis (L), thus allowing two of the mixer-insert parts (2, 2*a*, 2*b*) to be inserted into each other perpendicular to the longitudinal axis (L) without one of the mixer-insert parts (2, 2*a*, 2*b*) bending perpendicular to the longitudinal axis (L).

16. A static mixer comprising a tubular container and a mixer insert (1) according to claim 1 disposed therein.

17. A method for producing a mixer insert according to claim 1, comprising the steps of:

providing at least two mixer-insert parts (2, 2*a*, 2*b*) which are injection-molded and extend along a longitudinal axis and each have a plurality of integrally interconnected mixing-element parts (14, 14*a*, 14*b*, 14*c*, 14*d*; etc. 15, 15*a*, 15*b*, 15*c*, 15*d*, etc.) disposed one behind the other along the longitudinal axis (L) and immediately adjoining each other, of which at least two immediately adjoining mixing-element parts (14, 14*a*, 14*b*, 14*c*, 14*d*; etc. 15, 15*a*, 15*b*, 15*c*, 15*d*, etc.) are turned relative to each other by a twist angle, joining the mixer-insert parts (2, 2*a*, 2*b*) in at least one assembly direction, which extends perpendicular to the longitudinal axis (L), in such a manner that the mixing-element parts (14, 15; 14*a*, 15*a*; 14*b*, 15*b*; 14*c*, 15*c*; 14*d*, 15*d*; etc.) that are disposed next to each other perpendicular to the longitudinal axis of the mixer-insert parts (2, 2*a*, 2*b*) come together to form one of the mixer inserts (3, 3*a*, 3*b*, 3*c*, 3*d*, etc.), of which at least two mixing elements (3; 3*a*, 3*b*; 3*b*, 3*c*; 3*c*, 3*d*; etc.) disposed next to each other along the longitudinal axis (L) are turned 90° relative to each other by the twist angle.

18. The mixer insert according to claim 1, wherein the twist angle is 90°.

19. The mixer insert according to claim 1, wherein the plurality of mixing elements immediately adjoin each other.

* * * * *